US009284089B2

(12) United States Patent
Ikeda

(10) Patent No.: US 9,284,089 B2
(45) Date of Patent: Mar. 15, 2016

(54) CARTON FOR PACKAGING ARTICLES, BLANK AND METHOD FOR FORMING SAME

(75) Inventor: Tamio Ikeda, Kanagawa (JP)

(73) Assignee: WestRock Packaging Systems, LLC, Norcross, GA (US)

( * ) Notice: Subject to any disclaimer, the term of this patent is extended or adjusted under 35 U.S.C. 154(b) by 18 days.

(21) Appl. No.: 14/009,148

(22) PCT Filed: Mar. 29, 2012

(86) PCT No.: PCT/US2012/031125

§ 371 (c)(1), (2), (4) Date: Jun. 6, 2014

(87) PCT Pub. No.: WO2012/138535

PCT Pub. Date: Oct. 11, 2012

(65) Prior Publication Data

US 2014/0291386 A1 Oct. 2, 2014

Related U.S. Application Data

(60) Provisional application No. 61/471,544, filed on Apr. 4, 2011.

(51) Int. Cl.

| | |
|---|---|
| ***B65D 5/42*** | (2006.01) |
| ***B65D 71/22*** | (2006.01) |
| ***B65D 71/18*** | (2006.01) |

(52) U.S. Cl.

CPC ..... *B65D 5/4204* (2013.01); *B65D 71/18* (2013.01); *B65D 71/22* (2013.01); (Continued)

(58) Field of Classification Search

CPC ..... B65D 5/4204; B65D 71/18; B65D 71/22; B65D 2571/00716; B65D 2571/00265; B65D 2571/00444; B65D 2571/00308; B65D 2571/00759; B65D 2571/00185; B65D 2571/00845; B65D 2571/00141; B65D 2571/00567; B65D 2571/0066

USPC ..... 229/162.3, 162.6; 206/772, 773, 774

See application file for complete search history.

(56) References Cited

U.S. PATENT DOCUMENTS

| | | | |
|---|---|---|---|
| 2,182,065 | A | 12/1939 | Warren |
| 2,200,813 | A | 5/1940 | Warren |

(Continued)

FOREIGN PATENT DOCUMENTS

| | | |
|---|---|---|
| DE | 1145091 B | 3/1963 |
| EP | 0340920 | 11/1989 |

(Continued)

OTHER PUBLICATIONS

International Search Report for PCT/US2012/031125 dated Jun. 4, 2012.

*Primary Examiner* — Gary Elkins

(74) *Attorney, Agent, or Firm* — WestRock Intellectual Property Group

(57) ABSTRACT

A package includes a carton (2) and articles (A). The carton includes primary walls (10, 12, 14, 16, 18) a first one (16) of which has at least one window flap (64) struck therefrom. The at least one window flap is connected at its hinged connection (68) to the first wall (16) for movement between a first position in which the at least one window flap is coplanar with the first wall and a second position in which the at least one window flap extends into the interior volume to define a window (66) in the first wall through which one of the articles is exposed to view. The at least one window flap (64) is allowed to move unimpeded by the one article when moving from the first position to the second position whereas it is in engagement at its free end edge at least in part with the one of the articles when in the second position.

13 Claims, 6 Drawing Sheets

(52) U.S. Cl.
CPC ..... *B65D 2571/0066* (2013.01); *B65D 2571/00141* (2013.01); *B65D 2571/00185* (2013.01); *B65D 2571/00265* (2013.01); *B65D 2571/00308* (2013.01); *B65D 2571/00444* (2013.01); *B65D 2571/00567* (2013.01); *B65D 2571/00716* (2013.01); *B65D 2571/00759* (2013.01); *B65D 2571/00845* (2013.01)

(56) References Cited

U.S. PATENT DOCUMENTS

| | | | | | |
|---|---|---|---|---|---|
| 2,563,065 | A | * | 8/1951 | Price | 206/171 |
| 2,867,320 | A | | 1/1959 | Noble | |
| 2,881,914 | A | | 4/1959 | Woeber et al. | |
| 2,889,957 | A | | 6/1959 | Kilmartin | |
| 2,946,436 | A | | 7/1960 | Williamson | |
| 3,027,996 | A | | 4/1962 | Transport | |
| 3,163,321 | A | | 12/1964 | Weiss | |
| 3,278,075 | A | | 10/1966 | Weiss | |
| 3,298,504 | A | * | 1/1967 | Carter | 206/777 |
| 3,337,033 | A | | 8/1967 | Cote | |
| 3,386,570 | A | * | 6/1968 | Lock | 206/197 |
| 3,411,696 | A | * | 11/1968 | Ayer et al. | 206/525 |
| 3,424,299 | A | | 1/1969 | Rosenberg | |
| 3,462,011 | A | * | 8/1969 | Farquhar | 206/152 |
| 3,741,380 | A | | 6/1973 | Carney | |
| 3,750,935 | A | * | 8/1973 | Akkerman | 206/161 |
| 4,327,829 | A | * | 5/1982 | Hughes | 206/193 |
| 4,373,630 | A | | 2/1983 | Oliff | |
| 4,397,416 | A | * | 8/1983 | Bishop | 229/117.13 |
| 4,421,232 | A | | 12/1983 | Konaka | |
| 4,533,047 | A | | 8/1985 | Calvert | |
| 4,570,787 | A | | 2/1986 | Forbes | |
| 5,595,299 | A | | 1/1997 | LeBras | |
| 5,657,864 | A | * | 8/1997 | Harrelson | 206/152 |
| 6,527,108 | B1 | | 3/2003 | Blin et al. | |
| 6,619,483 | B1 | | 9/2003 | Paine | |
| 2006/0091193 | A1 | | 5/2006 | Debusk | |
| 2014/0054191 | A1 | * | 2/2014 | Psalidas et al. | 206/427 |

FOREIGN PATENT DOCUMENTS

| | | |
|---|---|---|
| EP | 1533246 | 5/2005 |
| FR | 1436041 | 4/1966 |
| GB | 2124592 | 2/1984 |
| WO | 9603328 | 2/1996 |
| WO | 9858853 | 12/1998 |
| WO | 0234639 | 5/2002 |
| WO | WO2005-044549 | 5/2005 |
| WO | WO2005-123533 | 12/2005 |
| WO | WO2009-091969 | 7/2009 |
| WO | WO2012-109627 | 8/2012 |

* cited by examiner

CARTON FOR PACKAGING ARTICLES, BLANK AND METHOD FOR FORMING SAME

FIELD OF THE INVENTION

The present invention relates to cartons for packaging one or more articles and methods of forming such cartons from blanks. More specifically, though not exclusively, the present disclosure relates to carton that provides a window through which a portion of the carton's contents may be viewed, and methods for forming such a window.

BACKGROUND OF THE INVENTION

In the field of packaging, it is often required to provide consumers with a package comprising multiple primary product containers. Such multi-packs are desirable for shipping and distribution and for display of promotional information. It is, however, desirable that the end consumer be able to view the primary containers whilst contained in such a package, as a means of reassuring the consumer as to what is contained therewithin.

A window through which a substantial portion of an article contained in the package may be viewed would tend to introduce a potential weakness in the containment of the articles and may lead to unintentional egress of one or more of those articles from the package.

It is, therefore, desirable that a carton is provided with a window that does not suffer from such disadvantage. In addition, it is further desirable that the window be provided in the carton through as simple a set of folding operations as possible so as to aid automation of the carton erection and loading process.

SUMMARY OF INVENTION

The present disclosure seeks to overcome or at least mitigate the above identified issues.

Statements of invention following wording of patent claims.

According to a first aspect of the present invention there is provided a carton for articles, which carton comprises walls defining an interior volume into which articles may be loaded, a first of which walls comprises window flaps that are hinged to that first wall and that are hingeable between a first position in which they are coplanar with the first wall and offset from one another by an aperture, and a second position in which they extend into the interior volume.

Preferably, free edges of the window flaps are curved such that the window flaps have a greater width at an intermediate point along a length thereof, than at either of opposed ends thereof.

Preferably or alternatively, the window flaps are hinged to the first wall by a curved fold line such that hinging the window flaps caused deformation of the first wall.

Preferably the deformation of the first wall resists the hinging of the window flaps into said second position.

A second aspect of the present disclosure provides a blank for forming a carton, which blank comprises panels for forming walls of the carton that define an interior volume into which articles may be loaded, a first of which panels comprises window flaps that are hinged to that first panel and that are hingeable between a first position in which they are coplanar with the first panel and offset from one another by an aperture, and a second position in which they extend into the interior volume, when the carton is erected.

Preferably, free edges of the window flaps are curved such that the window flaps have a greater width at an intermediate point along a length thereof, than at either of opposed ends thereof.

Preferably, or alternatively, the window flaps are hinged to the first panel by a curved fold line such that hinging the window flaps caused deformation of the first panel.

Preferably, the deformation of the first panel resists the hinging of the window flaps into said second position.

A third aspect of the disclosure provides a method of forming a package, which method comprises providing a blank that comprises panels for forming walls of a carton, a first of which panels comprises window flaps that are hinged to that first panel and that are hingeable between a first position in which they are coplanar with the first panel and offset from one another by an aperture, and a second position in which they extend into the interior volume, when the carton is erected; folding the blank such that the panels thereof form walls of a carton that define an interior volume in which articles are disposed; hinging the window flaps, from a first position substantially coplanar with the first panel, inwardly of that interior volume toward the articles, thereby to bring free edges of those window flaps into abutment with portions of one or more of those articles, which abutment retains the window flaps in said second position.

Preferably a curved fold line hinging the window flaps to the first panel causes deformation of the first wall as the window flaps are folded into said second position.

Preferably the deformation of the first wall resists the hinging of the window flaps into said second position.

BRIEF DESCRIPTION OF THE DRAWINGS

Exemplary embodiments will now be described with reference to the accompanying drawings, in which.

DETAILED DESCRIPTION OF EXEMPLARY EMBODIMENTS OF THE PRESENT DISCLOSURE

Figure 1:
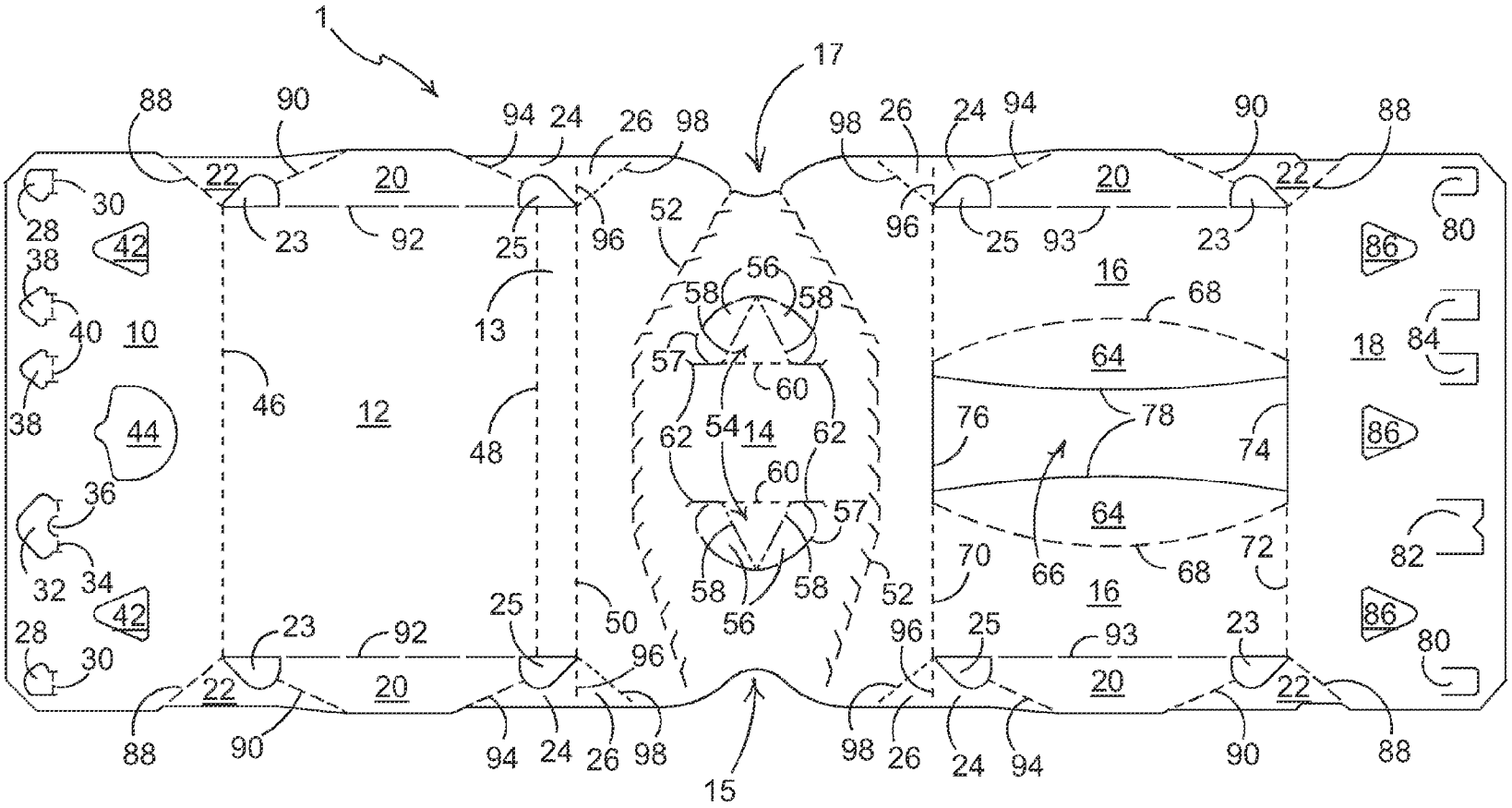
FIG. 1 is a plan view of a blank according to a first embodiment of the disclosure.

Detailed descriptions of specific embodiments of the package, blanks and cartons are disclosed herein. It will be understood that the disclosed embodiments are merely examples of the way in which certain aspects of the disclosure can be implemented and do not represent an exhaustive list of all of the ways the disclosure may be embodied. Indeed, it will be understood that the packages, blanks and cartons described herein may be embodied in various and alternative forms. The figures are not necessarily to scale and some features may be exaggerated or minimised to show details of particular components. Well-known components, materials or methods are not necessarily described in great detail in order to avoid obscuring the present disclosure. Any specific structural and functional details disclosed herein are not to be interpreted as limiting, but merely as a basis for the claims and as a representative basis for teaching one skilled in the art to variously employ the disclosure.

A first preferred aspect of the present disclosure provides a blank 1 for forming a carton 2 suitable for packaging articles A and a method of erection thereof. The blank 1, preferably formed of some foldable sheet material such as paperboard or similar, has the following features.

The blank 1 comprises a linear series of panels having a bottom panel 10, first side panel 12, top panel 14, second side panel 16 and second bottom panel 18 hinged one to the next in a linear series by corresponding fold lines 46, 50, 70 and 72. Disposed at opposed side edges of the side panels 12, 16 are end retention means comprising end flaps 20, lower gussets 22, and upper gussets 24 hinged to top gussets 26. The lower gussets 22 are hinged to the first bottom panel 10 by fold lines 88 and to the end flaps 20 by fold lines 90. The end flaps 20 are then hinged at an opposing end thereof to the upper gussets 24 by fold lines 94, which upper gussets 24 are in turn hinged to the top gussets 26 by fold lines 96. The top gusset 26 is then hinged to the top panel 14 by fold line 98. The lower gussets 22 and upper gussets 24 are separated from proximate parts of the respective adjacent one of the first 12 or the second 16 side panels by corresponding apertures 23, 25.

Figure 3:
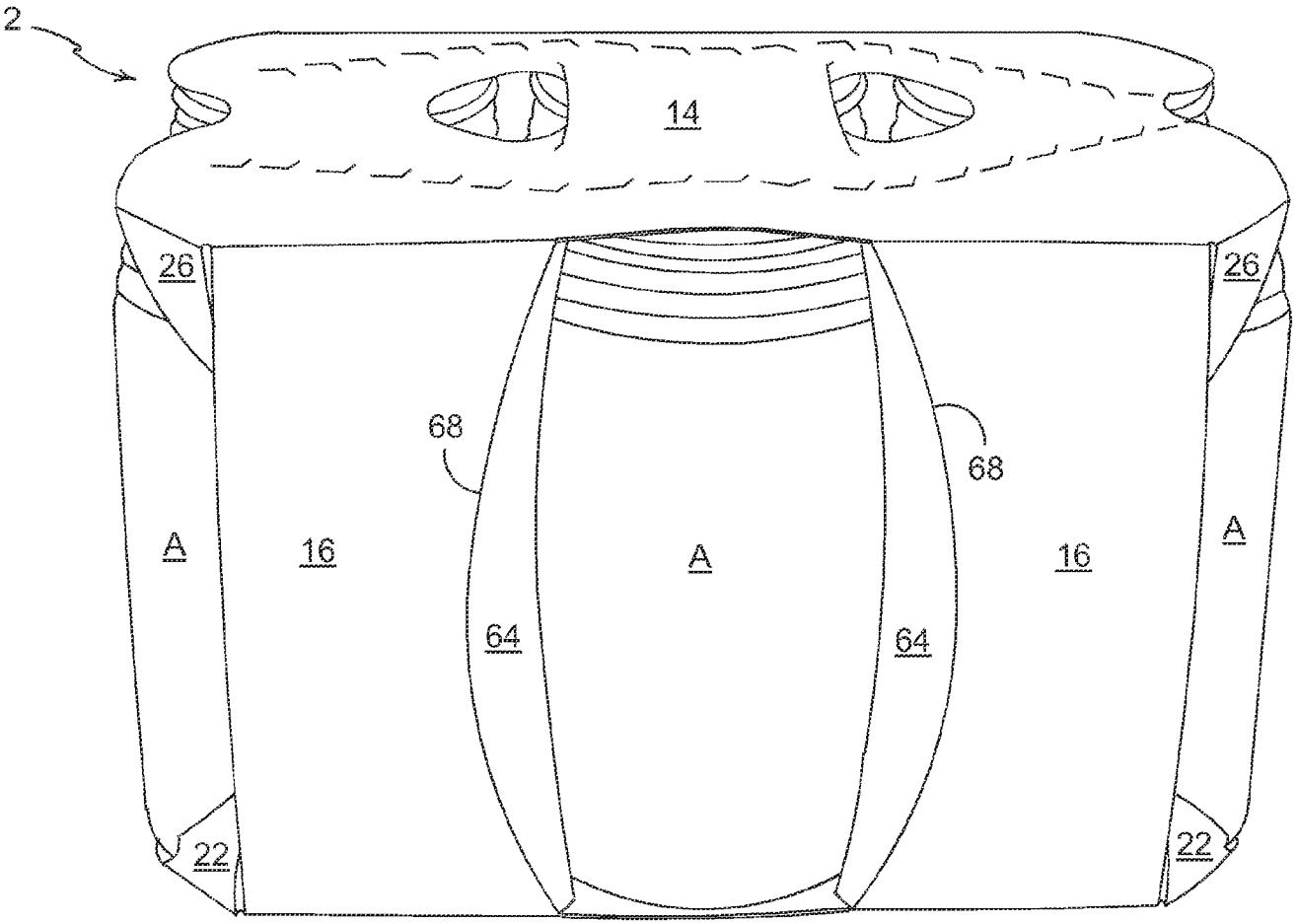
FIG. 3 is a perspective view of the carton of FIG. 2 wherein a window in a wall thereof has been set up to allow the contents of the carton to be viewed therethrough.

The second side panel 16 comprises flaps for forming a window structure through which ultimately an article A might be visible from within the erected carton 2 as best shown in FIG. 3. The window structure comprises first and second window flaps 64 that are hinged to corresponding side portions of the second side panel 16 by arched or otherwise curved fold lines 68, and are spaced from one another by an aperture 66 formed between juxtaposed edges 78 of the window flap 64 and by outline portions 74, 76 that extend collapsibly to interrupt the fold line 70, 72 hinging the second side panel 16 to the top panel 14 and second bottom panel 18 respectively. The window flaps 64 may be arranged such that their free edges 78 and curved fold lines 68, are offset from one another by a greater distance adjacent the top panel 14 and adjacent the bottom panel 110. As with the fold line 68 of the first embodiment, the fold lines 68 are positioned such that the window flaps 64 are positioned on opposite sides of the center (or window) article A when they are folded inwardly of the carton. The free edges 78 are spaced from each other to allow the window flaps to be moved substantially unimpeded by the center (or window) article to the second position. The term "center article" or "window article" as used herein refers to a can, bottle or other article that is placed next to the second side wall 16 between the window flaps 64. The term "substantially unimpeded" as used herein means that the window flaps 64 are foldable inwardly of the carton without being obstructed by the window article an/or the other articles adjacent the second side wall 16 or otherwise means that the window flaps 64 are capable of being folded inwardly of the carton, with little deformation thereof, by virtue of the presence of the articles adjacent the second side wall 16. In the latter optional embodiment wherein the window flaps 64 are folded with the "little deformation", the window flaps 64 are pressed against the window article, and thereby somewhat deformed, to the extent that the window flaps 64 create a frictional contact with the window article and are prevented from hinging back outward of the carton once they reach the second position. However, the term "substantially unimpeded" also means that the window flaps 64 are not torn or otherwise substantially wrinkled due to the folding operation to the extent that some after- or post-folding treatment for fixing their appearance is required. The geometry of the window flaps 64 is therefore a function of the location of the window flaps 64 as well as the geometry of the articles that are to be contained in the carton.

Figure 2:
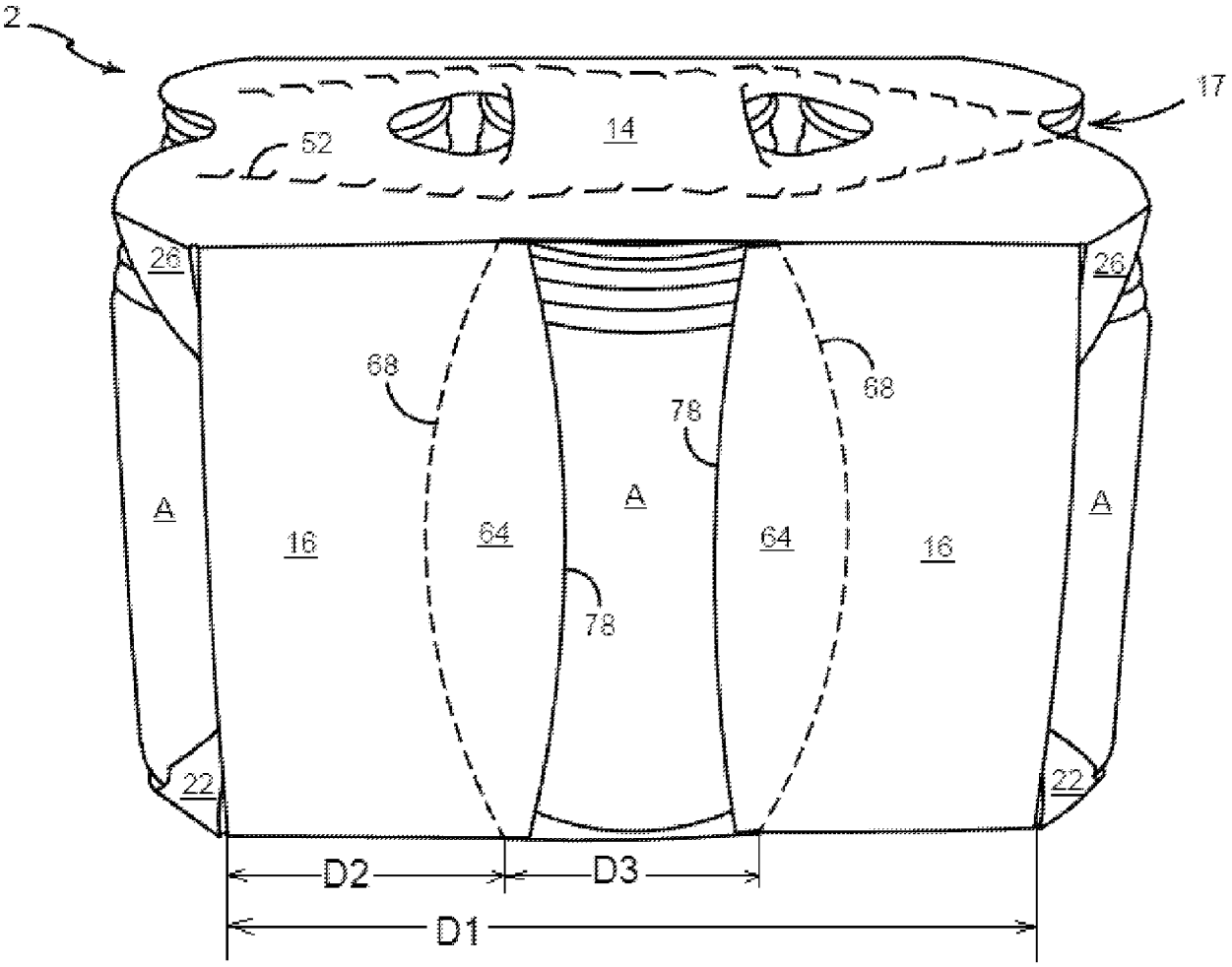
FIG. 2 is a perspective view of a partially set up carton formed from the blank of FIG. 1, loaded with an array of articles.

In the illustrated embodiment, the articles A are cans or similar cylindrical items, and as such the illustrated window flap geometries and window flap locations accommodate the passage of the window flaps 64 passed adjacent exterior portions of those articles A with only a small amount of deformation thereof as the free edges 18 thereof abut and slide passed those exterior portions. More specifically, the illustrated blank 1 and carton 2 are designed to package six (6) standard 12 oz cans arranged in a 2×3 configuration. Referring to FIGS. 1 and 2, the length D1 of, or first distance between the fold lines 93 and 93 of, the second side wall 16 is considerably less than three (3) times the diameter of each can A so that substantial portions of the end cans may be exposed to view as best shown in FIG. 2. The locations of the window flaps 64 are such that the opposite ends of each arched fold line 68 is located at a second distance D2 measured from the adjacent one of the fold lines 93 and 93 and that the distance D3 between the upper (or lower) ends of the arched fold lines 68 is substantially less than the diameter of each can A where each of the second and third distances D2 and D3 is about one third of the first distance D1. The radius of each arched fold line 68 is, preferably but not limited to, approximately two thirds of the first distance d1. The distance D3 between the lower ends of the arched fold lines 68 may be somewhat less than the distance between the upper ends of the arched fold line 68 depending on the geometry of the articles, which will be described further with the description of the second embodiment.

The top panel 14 comprises a tear access means that extends between cutaway portions 15, 17 of side edges of the top panel 14, the tear access portion being defined between twin frangible cut lines 52 that extend from the second cutaway portion 17 in that side edge of the top panel 14, which twin frangible lines diverge away from one another as they extend away from the second cut portion 17 before extending substantially parallel to one another and then converging thereafter relatively proximate one another at the opposing side edge adjacent the first cutout portion 15 of the side edge of the top panel 14.

Defined between the diverging twin frangible lines 52 is a finger flap arrangement comprising opposed finger flaps 54 defined in the top panel 14 by substantially semicircular cut lines 57 and hinged to the top panel 14 by a straight fold line 60. Each finger flap 54 has twin fold lines 58 that extend from terminal points on that fold line 60 and that converge to intersect therebetween on a point opposite that fold line on a cut line 57 defining an outer edge of the finger flap 54 itself. Further extending from and coaxial with terminal points on the fold line 60 are cut line portions 62 that preferably terminate in J-shaped cuts to direct stress from the use of the material of the top panel 14 between the two finger apertures 54 as a strap handle by which the formed carton 2 might be suspended. The converging fold lines 58 in each finger aperture allow deformation thereof as the finger flap 54 is folded inwardly of the carton and passes in parts between articles disposed therebeneath.

The first 10 and second 18 bottom panels comprise complementary tabs and apertures by which the one may be secured in engagement with the other. Preferably the first bottom panel comprises a pair of opposing edge tabs 28 defined therein and hinged thereto by a fold line 30 between which are disposed secondary tabs 38 also defined therein, each of which are hinged thereto by fold line 40 and a tertiary engagement tab 32 also defined therein and hinged thereto by a fold line 36 which fold line 34 is interrupted by a detent 36 that extends partially into and is struck from the tertiary engaging tab 32 in use. In the second bottom tab 18 there are formed complementarily sized apertures that are defined by deformable portions that yield in response to the insertion of the tabs 28, 38, 32 thereby to allow enlarged heads of those tabs to become inserted in the apertures thereby to dissuade disengagement thereof. The apertures comprise opposed edge apertures 80, twin secondary apertures 84 and tertiary aperture 82 each of which are sized and positioned to allow alignment when the blank 1 is folded in the manner described below with the corresponding edge tabs 28, secondary tabs 38 and tertiary tab 32. Preferably apertures may also be formed in both the first 10 and second 18 bottom panels, which apertures may take the form as illustrated in FIG. 1 of first and second triangular apertures 48 disposed between which is a hemispherical aperture 44 and triple triangular apertures 86 in the second bottom panel 18.

One possible manner in which the blank 1 might be erected into a loaded carton 2 is herein described and may be performed as follows. A group of articles A may be positioned in a 2×3 array beneath the top panel 14 of the blank 1. The first and second 12, 16 side panels of the blank are then folded downwardly about the respective fold lines 50, 70 hinging them to the top panel 14 whilst simultaneously the end retaining flaps 20 along each side of both the first 12 and second 16 side panels are folded substantially 180° into coplanar contact with portions of those side panels 12, 16. This folding of the retaining flaps 20 causes as a result of the provision of the gusset panels 22, 24, 26 an automatic folding of the first 10 and second 18 bottom panels also, thus as the side panels 12, 16 are brought down into contact with side portions of adjacent ones of the articles A in the 2×3 array the retaining flaps 20 become sandwiched between portions of selected ones of those articles A and the adjacent one of the first 12 and second 16 side panels and the first 10 and second 18 bottom panels become disposed at least partially beneath the array of articles A. The lower gussets 22 are provided to retain lower portions of the endmost articles A of the array whilst the upper gussets 24 are similarly provided to retain upper portions of those endmost articles A of the array through securement of the first bottom panel 10 to the second bottom panel 18 through insertion of the tabs 28, 38, 32 into the corresponding apertures 80, 84, 82, a composite bottom panel is created beneath the articles A and the enclosure of the articles within the resulting carton 2 is achieved.

Subsequent to the foregoing folding operations the window flaps 64 are folded inwardly of the carton 2 to abut a central article A of the array adjacent the second side panel 16. This inward folding of the window flaps 64 causes, by virtue of the curvature of the fold line 68 hinging the window flaps 64 to the second side panel 16, deformation of that second side panel 16. The curvature also means that the window flaps 64 resist being folded inwardly of the carton as the material will resist this deformation. This subsequent folding of the window flaps 64 after the articles A are loaded in the carton 2 is made possible by the fact that the window panels 64 are spaced from one another by the aperture 66, meaning that the maximum widths of the window flaps 64 are sufficiently short so to allow the passage of the window flap 64 inwardly of the carton 2 without overly fouling an outer surface of the central article A. The free edges 78 of the window flaps 64 curve convexly relative to one another, thereby presenting a curved abutment edge 78 to the outer surface of the central article A. This curvature of the abutment edge 78 allows the edge to penetrate deeper into the carton 2 once folded inwardly and thereby to establish a larger contact surface with the central article A. This is of particular importance because the offset between the curved fold line 68 and each of the upper and lower edges of the central article A is smaller that the distance between the middle area of the central article A and the middle area of the curved fold line 68, thus the curve of the abutment edge 78 provides additional material to bridge this offset.

Once positioned in abutment with the central article A, the window flaps 64 are urged against the surface thereof by the resilient biasing of the deformed material of the second side panel 16. This biasing resists additional inward folding of the window flaps 64 that could possibly serve to widen the aperture 66 between the window flaps sufficiently to allow unintentional egress of the central article A. In addition, the distance between juxtaposed uppermost points on the curved fold line 68, and between juxtaposed lowermost points on the curved fold lines 68 id preferably chosen to be smaller than the width of the central article A, thereby causing the upper and lower portions of that article A to be retained within the carton 2 also by interior portions of the second side panel proximate those uppermost and lowermost points on the curved fold line 68.

Figure 4:
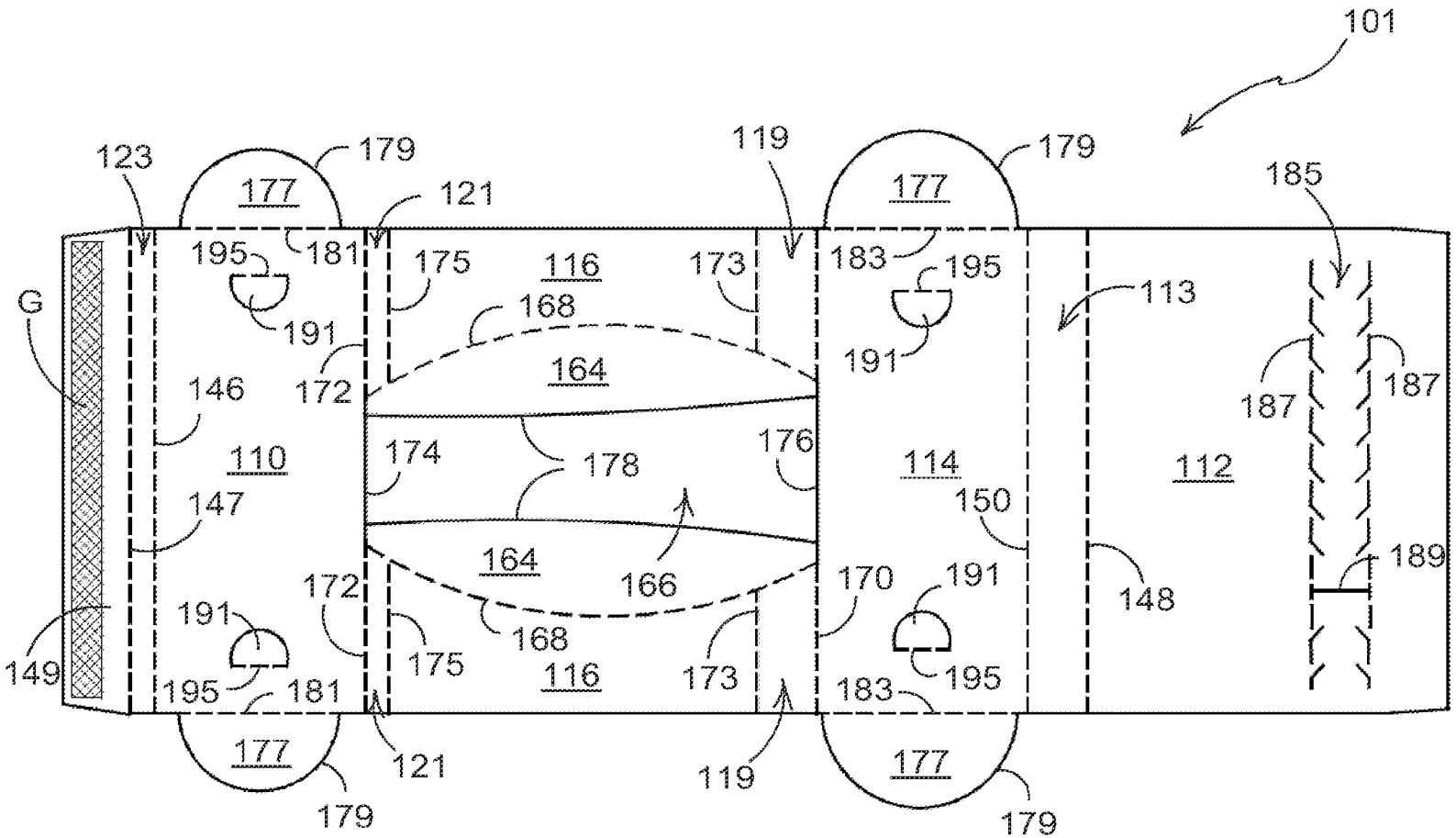
FIG. 4 is a plan view of a blank according to a second embodiment of the disclosure.
Figure 5:
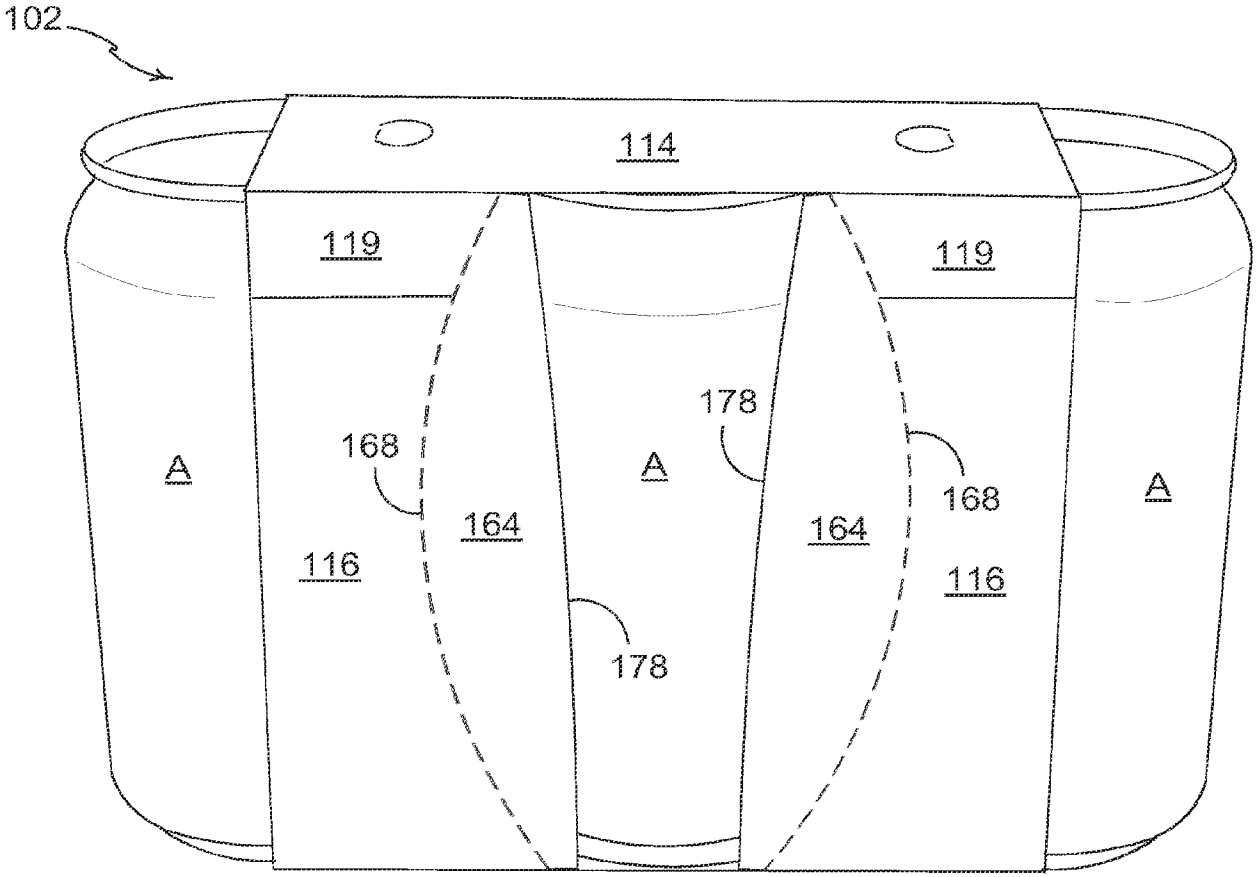
FIG. 5 is a perspective view from above of a partially set up carton formed from the blank of FIG. 4, loaded with an array of articles.
Figure 6:
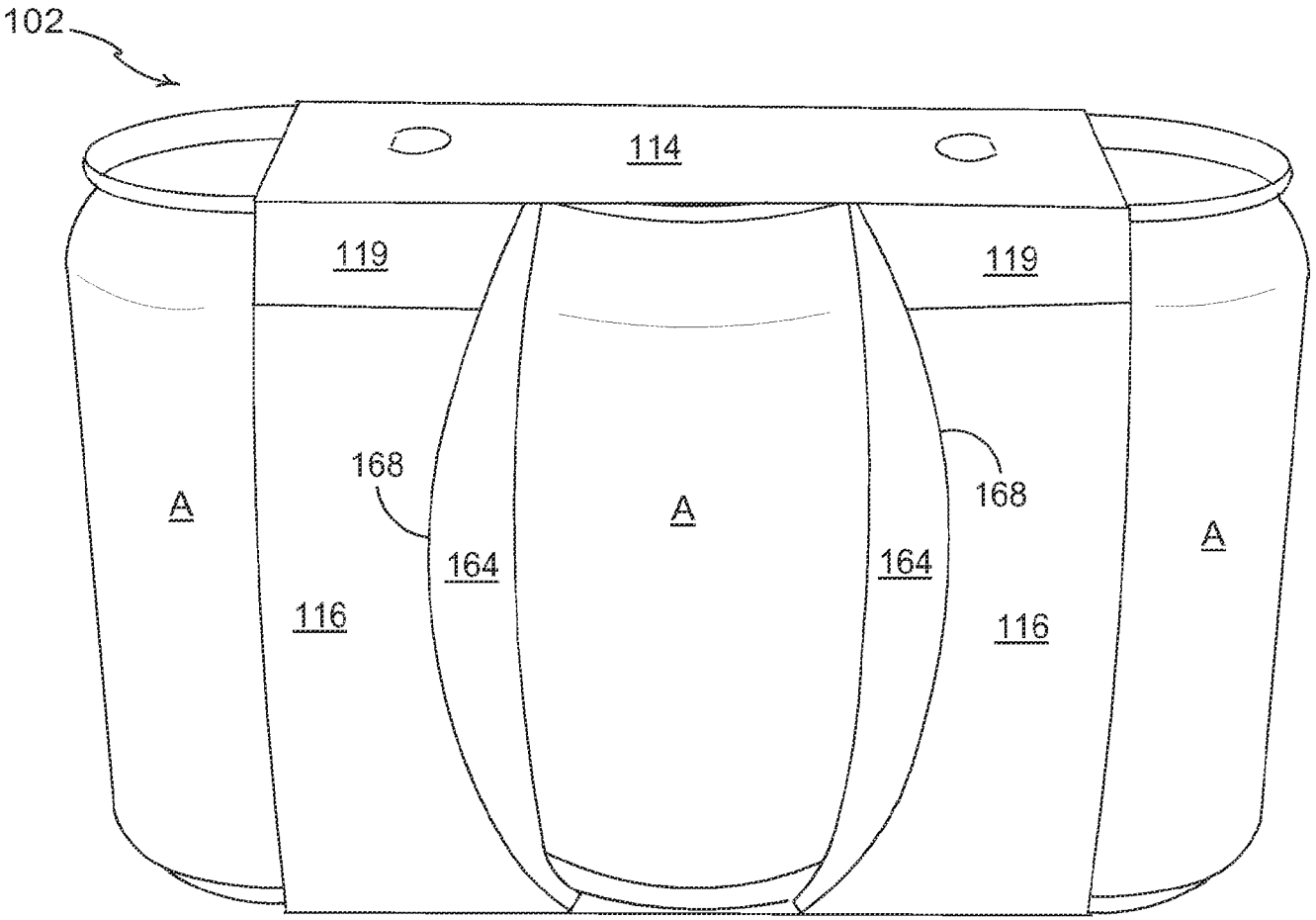
FIG. 6 is a perspective view of the carton of FIG. 5 wherein a window in a wall thereof has been set up to allow the contents of the carton to be viewed therethrough.

A blank 101 for forming a carton 102 according to a second preferred embodiment of the present disclosure is now described, with reference to FIGS. 4 to 6. This second embodiment is substantially similar to the first and like reference numerals have been used to denote like features, prefixed by a "1" Only the differences between the two embodiments are described below.

The blank 101 comprises a glue tab 149, bottom panel 110, second side panel 116, top panel 114 and first side panel 112, hinged one to the next, in a linear series by corresponding fold lines 146, 172, 176, 150.

The glue panel 149 comprises a fold line 147 that defines a bevel portion 123 extending along and adjacent to the bottom panel 110. Similarly, the second side panel 116 also comprises a fold line 175 that defines a bevel portion 121 along and adjacent to the bottom panel 110. This bevel portion 121 is interrupted by the window flaps 164 defined in this second side panel 116. The fold line 175 defining the bevel portion 121 does not extend across either fold line 168 connecting the window flaps 164 to the second side panel 116. In this manner the window flaps 164 extend fully between the top 114 and bottom 110 panels.

Along the opposing end of the second side panel 116, a further bevel portion 119 is defined by another fold line 173 extending between side edges thereof parallel to and offset from the top panel 114. In the same manner as the opposing bevel portion 121, the window flaps 164 interrupt this bevel portion 119 to extend to the fold line connecting the second side panel 116 and the top panel 114.

As with the first embodiment, the window flaps 164 are connected to the second side panel 116 by curved fold lines 168, but these curved fold lines may be arranged such that there is a greater spacing between terminal points thereof adjacent the top panel 114 than there is between terminal points thereof adjacent the bottom panel 110. As with the first embodiment, the free edge 178 of the window flaps 164 are curved and the window flaps 164 are sized to allow substantially unimpeded movement thereof inwardly of the carton.

The first side panel 112 comprises a tear access strip 185 defined between offset, preferably parallel, frangible lines 187 that extend across a majority of the width of the first side panel 112, between opposed free side edges thereof. A cut line 189 bridges between these two frangible lines 187 to provide a tear initiation point. Additionally, along and adjacent tot the top panel 114, the first side panel 112 comprises a fold line 148 defining, between it and the top panel 114, a bevel portion 113.

Both the top 114 and the bottom panel 110 comprise biasing flaps 191 defined therein proximate each opposing free end thereof. These biasing flaps are optionally semicircular in shape and hinged along their flat edge to the corresponding bottom 110 or top 114 panel. Disposed at each opposed end of the bottom 110 and top 114 panels are respective retention flaps 177. These retention flaps are preferably semicircular and hinged to a respective one of the bottom 110 and top 114 panels along their flat sides, by hinged fold lines 181, 183. The biasing flaps 191 and retention flaps 177 cooperate when the blank is erected into a carton 102 loaded with articles as described below.

One possible method of erecting the blank 101 of FIG. 4 into the carton 102 of FIG. 5 is as follows.

A group of articles A, in a 1×3 array, are assembled and the top panel 114 of the blank 101 disposed thereupon. The biasing flaps 191 and the retention flaps 177 are folded inwardly of the respective top 114 and bottom 110 panels such that the biasing flaps 191 are sandwiched between a respective one of the top 114 and bottom 110 panels and a retention flap 177. The retention flaps 177 align with upper circular rims of the articles A at each end of the 1×3 array.

A natural tendency of the material of the blank 101 to return to a flat planar condition urges the retention flaps 177 against the top surfaces of the endmost articles A of the array. The force with which the retention flaps 177 are so urged is increased by virtue of the presence of the biasing flaps 191, which urge against the inner surfaces of the retention flaps, as they themselves tend to unfold back into the plane of the of top panel 110. An upstanding circular rim of the articles provides an abutment surface that is contactable with a free peripheral edge 179 of the retention flaps to prevent unintentional egress of the articles from the completed carton 102.

The first 112 and second 116 side panels are then folded down, about the fold lines 150, 176 connecting them to the top panel 114, into contact with respective side portions of the array of articles A. In response to this folding operation, the bevel portions 113, 119 of the first 112 and second 116 side panels respectively, are folded out of the respective planes of those side panels 112, 116 and fold around angled and/or rounded upper edges of the proximate side partitions of the articles A. These bevel portions allow the articles A to be held more securely where the articles taper outwardly from their top surfaces (such as in the case of cans and bottles) because the top panel 114 may have the same width as the top surfaces of the articles, and yet the distance between the opposed side panels 112, 116 may be greater than this width of the top panel 114, thereby to accommodate the maximum width of the article A.

The retention flaps 177 and biasing flaps 191 of the bottom panel 110 are folded inwardly in the same manner as described above in respect of the biasing flaps 177 and retention flaps 191 of the top panel 114. The biasing flaps 191 are thereby sandwiched between the bottom panel 110 and the retention flaps 177 and the bottom panel is then folded under the array of articles A, thereby hinging the bevel portion 121 of the second side panel 116 adjacent thereto, around lower rounded or angled edges of the articles A.

The glue flap 149 is hinged upwardly about the fold line 146 connecting it to the bottom panel 110, thereby hinging the bevel portion 123 thereof around lower rounded or angled portions of the articles A. A glue strip G or some form of adhesive is applied to the glue flap 149 to secure it to contacting portions of the first side panel 112. Preferably, the glue flap 149 is sandwiched between the first side panel 112 and the array of articles A.

The resulting partially erected carton 102 is best shown in FIG. 5.

The window flaps 164 are then hinged inwardly of the carton 102 such that the free edges 178 thereof abut portions of an adjacent central article A of the array. This abutment secures the window flaps 164 in place, displaying the central article A therebetween. Some small degree of deformation may be required as the window flaps 164 are so hinged and preferably the material of which the carton 102 is formed has sufficiently flexibility to accommodate such deformation. The curvature of the fold lines 168 connecting the window flaps 164 to the second side panel causes a resultant convex bearing of that side panel 116 (from an exterior point of view) in the same manner as described above in relation to the first embodiment.

It can be appreciated that various changes may be made within the scope of the present invention, for example, the size and shape of the panels and apertures may be adjusted to accommodate articles of differing size or shape. In other embodiments of the invention it is envisaged that the nature of the curvature of the fold line hinging the window flaps the side panel of the carton may be altered from that shown, or may be replaced with linear fold lines. It is further contemplated that the window flaps may be provided in both of the opposing side panels, and that the or each pair of window flaps be positioned to expose a non-central article within the adjacent article row in the carton.

The bevel portions described above may be omitted or altered as desired to best fit around the upper and lower edges of the articles in the carton. Where, for example, the articles comprise not outwardly tapered sides, bevel portions may be unnecessary and therefore omitted. Even where bevel portions would be and advantageous because of the shape of the articles, it is not essential that they be included in the blank.

It is envisaged that the biasing flaps described above may be omitted or that both the biasing flaps and the retention flaps are omitted. Other means, such as apertures at or straddling the upper and lower edges of the side panels, through which portions of the adjacent articles may protrude, may be provided to retain the articles from unintentional egress.

It will be recognised that as used herein, directional references such as "top", "bottom", "front", "back", "end", "side", "inner", "outer", "upper" and "lower" do not limit the respective panels to such orientation, but merely serve to distinguish these panels from one another. Any reference to hinged connection should not be construed as necessarily referring to a single fold line only; indeed it is envisaged that hinged connection can be formed from one or more of the following, a short slit, a frangible line or a fold line without departing from the scope of the invention.

The invention claimed is:

1. A package comprising a carton and a plurality of articles, the carton comprising primary walls defining an interior volume in which the articles are received, a first wall of the primary walls comprising at least one window flap struck from the first wall, the at least one window flap having a hinged connection and an opposed free end edge, the at least one window flap being hingedly connected at the hinged connection to the first wall for movement between a first position in which the at least one window flap is coplanar with the first wall and a second position in which the at least one window flap extends into the interior volume to define a window in the first wall through which one of the articles is exposed to view, the at least one window flap is sized and shaped such that the at least one window flap is allowed to move substantially unimpeded by the one of the articles when moving from the first position to the second position and such that the at least one window flap is in engagement at the free end edge at least in part with the one of the articles when in the second position, wherein the free end edge of the at least one window flap is curved such that the at least one window flap has a greater width at an intermediate point along a length of the at least one window flap, than at either of opposed ends of the at least one window flap.

2. The package according to claim 1 wherein the at least one window flap comprises a pair of window flaps which together define the window when moved to the second position, the window flaps being spaced from each other when in the first position.

3. The package according to claim 1 wherein the hinged connection comprises a non-straight fold line such that the first wall is deformed when the at least one window flap is folded along the non-straight fold line into the second position.

4. The package according to claim 3 wherein the non-straight fold line is an arched line which bows concavely as viewed from the window.

5. The package according to claim 2 wherein the window flaps, when in the second position, provide masking panels for preventing the other articles from being exposed to view through the window.

6. A carton for holding articles, the carton comprising primary walls defining an interior volume into which the articles may be loaded, a first wall of the primary walls comprises at least one window flap struck from the first wall, the at least one window flap having a hinged connection and an opposed free end edge, the at least one window flap being hingedly connected at the hinged connection to the first wall for movement between a first position in which the at least one window flap is coplanar with the first wall and a second position in which the at least one window flap extends into the interior volume to define a window in the first wall through which one of the articles in the carton is exposed to view, the at least one window flap being sized and shaped such that the at least one window flap is allowed to move substantially unimpeded by one of the articles in the carton when moving from the first position to the second position and such that the at least one window flap is in engagement at the free end edge at least in part with one of the articles in the carton when in the second position, wherein the free end edge of the at least one window flap is curved such that the at least one window flap has a greater width at an intermediate point along a length of the at least one window flap than at either of opposed ends of the at least one window flap.

7. The carton according to claim 6 wherein the at least one window flap comprises a pair of window flaps which together define the window when moved to the second position, the window flaps being spaced from each other when in the first position.

8. The carton according to claim 6 wherein the hinged connection comprises a non-straight fold line such that the first wall is deformed when the at least one window flap is folded about the non-straight fold line toward the second position.

9. The carton according to claim 8 wherein the non-straight fold line is an arched line which bows concavely as viewed from the window.

10. The carton according to claim 7 wherein the window flaps, when in the second position, provide masking panels for preventing the other articles in the carton from being exposed to view through the window.

11. A blank for forming a carton, the blank comprising primary panels for forming walls of the carton that define an interior volume of the carton into which articles may be loaded, a first panel of the primary panels comprises at least one window flap struck from the first panel, the at least one window flap having a hinged connection and an opposing end edge, the at least one window flap being hingedly connected at the hinged connection to the first panel for movement between a first position in which the at least one window flap is coplanar with the first panel and a second position in which the at least one window flap extends into the interior volume to define a window in the first panel through which one of the articles in the carton is exposed to view when the carton is erected, the at least one window flap being sized and shaped such that the at least one window flap is allowed to move substantially unimpeded by one of the articles in the carton when moving from the first position to the second position and such that the at least one window flap is in engagement at the free end edge at least in part with one of the articles in the carton when in the second position, wherein the free end edge of the at least one window flap is curved such that the at least one window flap has a greater width at an intermediate point along a length of the at least one window flap than at either of opposed ends of the at least one window flap.

12. The blank according to claim 11 wherein the hinged connection comprises a non-straight fold line such that the first panel is deformed when the at least one window flap is folded about the non-straight fold line toward the second position.

13. A method of forming a package, the method comprising the steps of:

providing articles;

providing a blank that comprises primary panels for forming walls of a carton, a first panel of the primary panels comprises at least one window flap struck from the first panel, the at least one window flap having a hinged connection and an opposed free end edge, the at least one window flap being hingedly connected at the hinged connection to the first panel and disposed in a first position in which the at least one window flap is coplanar with the first panel;

manipulating the blank and articles such that the primary panels form the walls of the carton which define an interior volume and such that the articles are disposed substantially within the interior volume; and after the manipulating step, folding the at least one window flap from the first position to a second position in which the at least one window flap extends into the interior volume, wherein the free end edge of the at least one window flap is curved such that the at least one window flap has a greater width at an intermediate point along a length of the at least one window flap, than at either of opposed ends of the at least one window flap, and wherein hinging step comprises bringing the free end edge of the at least one window flap into engagement with one or more of the articles of the group so as to retain the at least one window flap in the second position.

* * * * *